US009181713B1

(12) United States Patent
Farahmandpour

(10) Patent No.: US 9,181,713 B1
(45) Date of Patent: Nov. 10, 2015

(54) SIDING ATTACHMENT SYSTEM

(71) Applicant: Kamran Farahmandpour, Long Grove, IL (US)

(72) Inventor: Kamran Farahmandpour, Long Grove, IL (US)

( * ) Notice: Subject to any disclaimer, the term of this patent is extended or adjusted under 35 U.S.C. 154(b) by 0 days.

(21) Appl. No.: 14/451,887

(22) Filed: Aug. 5, 2014

(51) Int. Cl.
*E04B 9/00* (2006.01)
*E04F 13/24* (2006.01)
*E04F 13/26* (2006.01)

(52) U.S. Cl.
CPC ..... *E04F 13/24* (2013.01); *E04F 13/26* (2013.01)

(58) Field of Classification Search
CPC ..... F16B 5/126; E04F 13/24; E04F 13/26
USPC ..... 52/478, 520, 519, 521, 522, 542, 543, 52/544
See application file for complete search history.

(56) References Cited

U.S. PATENT DOCUMENTS

| | | | | |
|---|---|---|---|---|
| 2,394,443 | A * | 2/1946 | Guignon, Jr. | 52/580 |
| 3,760,544 | A | 9/1973 | Hawes et al. | |
| 4,067,155 | A * | 1/1978 | Ruff et al. | 52/105 |
| 4,462,194 | A | 7/1984 | Wahner | |
| 4,597,702 | A | 7/1986 | Brown | |
| 5,007,222 | A * | 4/1991 | Raymond | 52/586.1 |
| 5,426,905 | A | 6/1995 | Rollhauser et al. | |
| 5,549,266 | A * | 8/1996 | Mitchell et al. | 248/205.1 |
| 5,611,184 | A | 3/1997 | Felix | |
| 5,660,015 | A | 8/1997 | Kluser | |
| 5,671,576 | A | 9/1997 | Kluser | |
| 5,678,383 | A * | 10/1997 | Danielewicz | 52/775 |
| 6,314,694 | B1 | 11/2001 | Cooper | |
| 6,588,165 | B1 * | 7/2003 | Wright | 52/506.05 |
| 7,059,577 | B1 | 6/2006 | Burgett | |
| 7,818,935 | B2 * | 10/2010 | Velickovic | 52/426 |
| 8,567,145 | B1 | 10/2013 | Chauncey | |
| 8,646,237 | B1 | 2/2014 | Takagi | |
| 2003/0070379 | A1 | 4/2003 | Worley | |
| 2006/0156679 | A1 * | 7/2006 | Pierret | 52/698 |
| 2007/0227086 | A1 | 10/2007 | Beavers et al. | |
| 2010/0307084 | A1 * | 12/2010 | Resso et al. | 52/302.1 |
| 2012/0317909 | A1 * | 12/2012 | MacKenzie | 52/288.1 |

* cited by examiner

*Primary Examiner* — Mark Wendell
(74) *Attorney, Agent, or Firm* — Erickson Law Group, PC

(57) ABSTRACT

Siding attachment system is disclosed having a base and an attachment member. The base has an engaging wall extending from a back plate. The engaging wall has a plurality of base teeth. The back plate is configured to attach to a support wall. The attachment member has a receiving wall extending from a mounting plate. The receiving wall has a receiving opening configured to receive the engaging wall. The receiving wall comprises two interior walls adjacent the receiving opening. Each interior wall comprises one or more receiving teeth extending into the receiving opening to engage one or more of the base teeth to releasably join the attachment member to the base. The mounting plate comprises a surface for supporting siding.

23 Claims, 4 Drawing Sheets

SIDING ATTACHMENT SYSTEM

FIELD OF THE INVENTION

This invention relates in general to system and devices for attaching siding.

BACKGROUND OF THE INVENTION

The use of continuous insulation is mandated for some climates in the United States by newer energy codes, such as 2012 International Energy Conservation Code (IECC) and 2012 International Green Construction Code. The purpose of continuous insulation is to eliminate thermal breaks that reduce thermal efficiency of insulation placed between framing members such as wall studs.

Siding can be placed over rigid insulation boards or foam that are placed outside of an air barrier (AB)/weather-resistive barrier (WRB). The use of continuous insulation with siding requires the siding to be connected to the to the support or back-up wall behind the AB/WRB. Some ties that pass through the continuous insulation and result in thermal leaks that reduce the efficiency of the continuous insulation.

The present inventor recognized the need for a siding attachment system that reduces thermal bridging where the continuous insulation is transversed. The present inventor recognized the need for a siding attachment system that is less susceptible to deterioration by moisture and weather conditions.

When installing continuous insulation panels, the panels are often installed in complete contact with the AB/WRB on the back-up surface. This prevents proper drainage of water on the exterior face of the AB/WRB. Water can be trapped in the minute gap between the continuous insulation and AB/WRB due to capillary action. This trapped water can cause accelerated deterioration of ties and other components.

The present inventor recognized the need for a siding attachment system that creates a gap between the continuous insulation panels and AB/WRB. This gap facilitates drainage.

Continuous insulation panels are often installed with adhesive backing to ensure they stay in place. This adhesive backing can impede drainage of water on the drainage plane and can degrade and fail over time under certain circumstances. This adhesive backing will also results in additional labor and material costs.

The present inventor recognized the need for a siding attachment system that can retain the continuous insulation panels in place and eliminate the need to rely on adhesive backing.

The present inventor recognized the need to transfer some compressive force from the siding attachment system onto the insulation to reduce or eliminate the possibility of buckling under compressive loads and to reduce the effective span within the cavity.

SUMMARY OF THE INVENTION

A siding attachment system is disclosed for connecting siding to a support wall. The system has a base and an attachment member. The base has an engaging wall extending from a back plate. The engaging wall has a plurality of base teeth. The back plate is configured to be attached to a support wall. The attachment member has a receiving wall extending from a mounting plate. The receiving wall has an elongated receiving opening configured to receive the engaging wall. The receiving wall has two interior walls adjacent the elongated receiving opening. Each interior wall has one or more receiving teeth extending into the receiving opening to engage one or more of the base teeth to releasably join the attachment member to the base. The mounting plate comprises a surface for supporting siding. The mounting plate is spaced apart from the back plate.

In some embodiments, the engaging wall is perpendicular to the back plate and the receiving wall is perpendicular to the mounting plate. The mounting plate is substantially parallel to the back plate when the attachment member is joined to the base. The elongated receiving opening extends along an entire vertical length of the receiving wall. The engaging wall has horizontally extending alignment bars on opposite exterior surfaces of the engaging wall. The receiving wall comprises horizontally extending alignment recesses. When the alignment bars are received in the alignment recesses, the attachment member is prevented from moving in the vertical direction. The surface for supporting siding of the mount plate comprises vertically extending fastener grooves for receiving fasteners connecting siding to the mount plate.

A method of attaching siding to a support wall is disclosed. A back plate of a base is attached to the support wall. The base has an engaging wall extending perpendicularly from the back plate. The engaging wall has a plurality of base teeth on opposite sides of the engaging wall. An elongated receiving recess of a receiving wall of an attachment member is aligning horizontally with the engaging wall. The elongated receiving recess is moved over the receiving wall. Receiving teeth on opposite sides of the elongated receiving recess are engaged with base teeth of the receiving wall to prevent the attachment member from moving in at least one first direction. Siding is attached to a mount plate of the attachment member.

In some embodiments one or more insulation panels are attached to the support wall by holding the insulation panel against the support wall with the mount plate of the attachment member.

Numerous other advantages and features of the present invention will become readily apparent from the following detailed description of the invention and the embodiments thereof, from the claims, and from the accompanying drawings.

DETAILED DESCRIPTION

Figure 1:
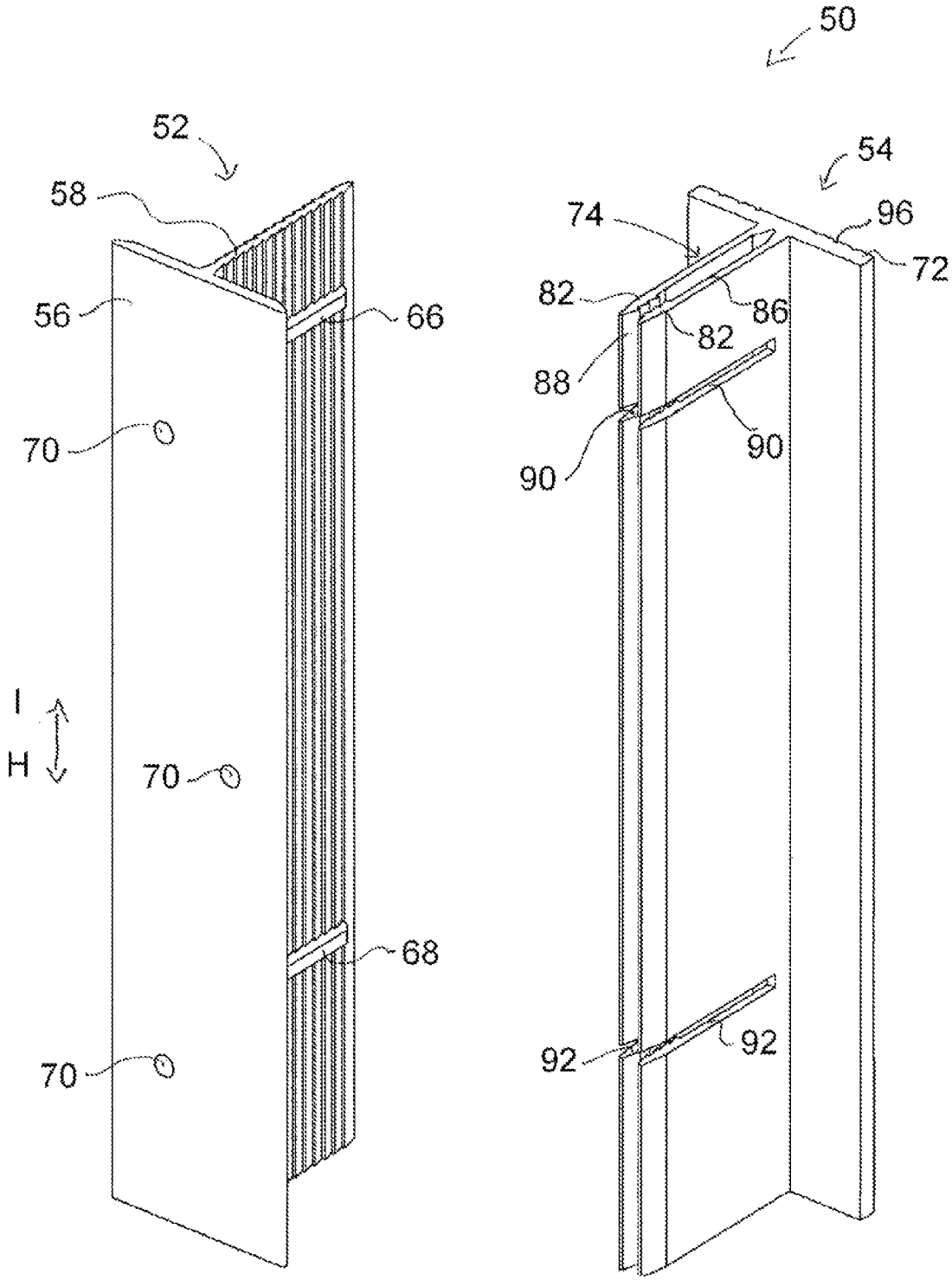
FIG. 1 is a perspective exploded view of a siding attachment system of the invention.

The following description is presented to enable any person skilled in the art to make and use the invention. For the purposes of explanation, specific nomenclature is set forth to provide a plural understanding of the present invention. While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
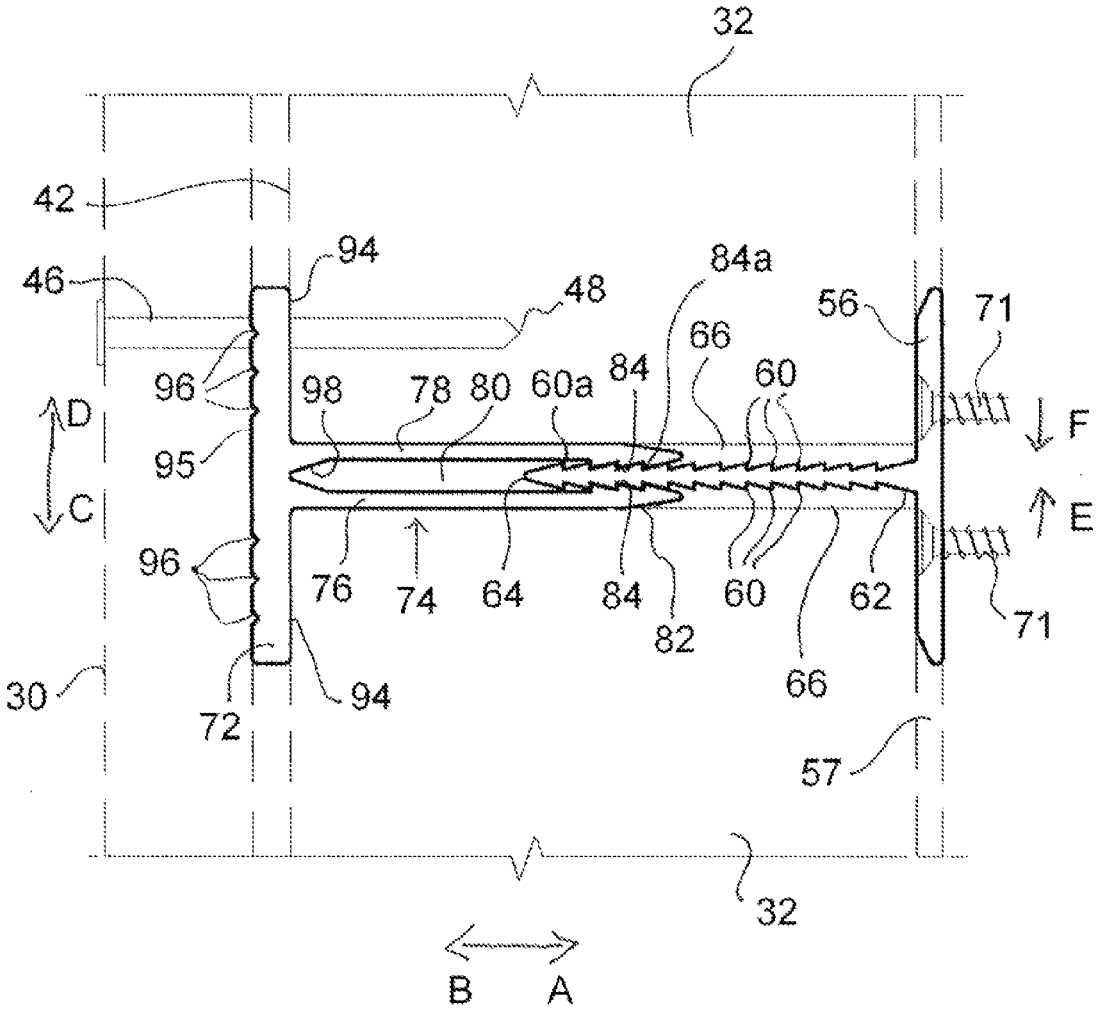
FIG. 2 is a top view of the attachment system of FIG. 1 with an attachment member engaged with a base.
Figure 3:
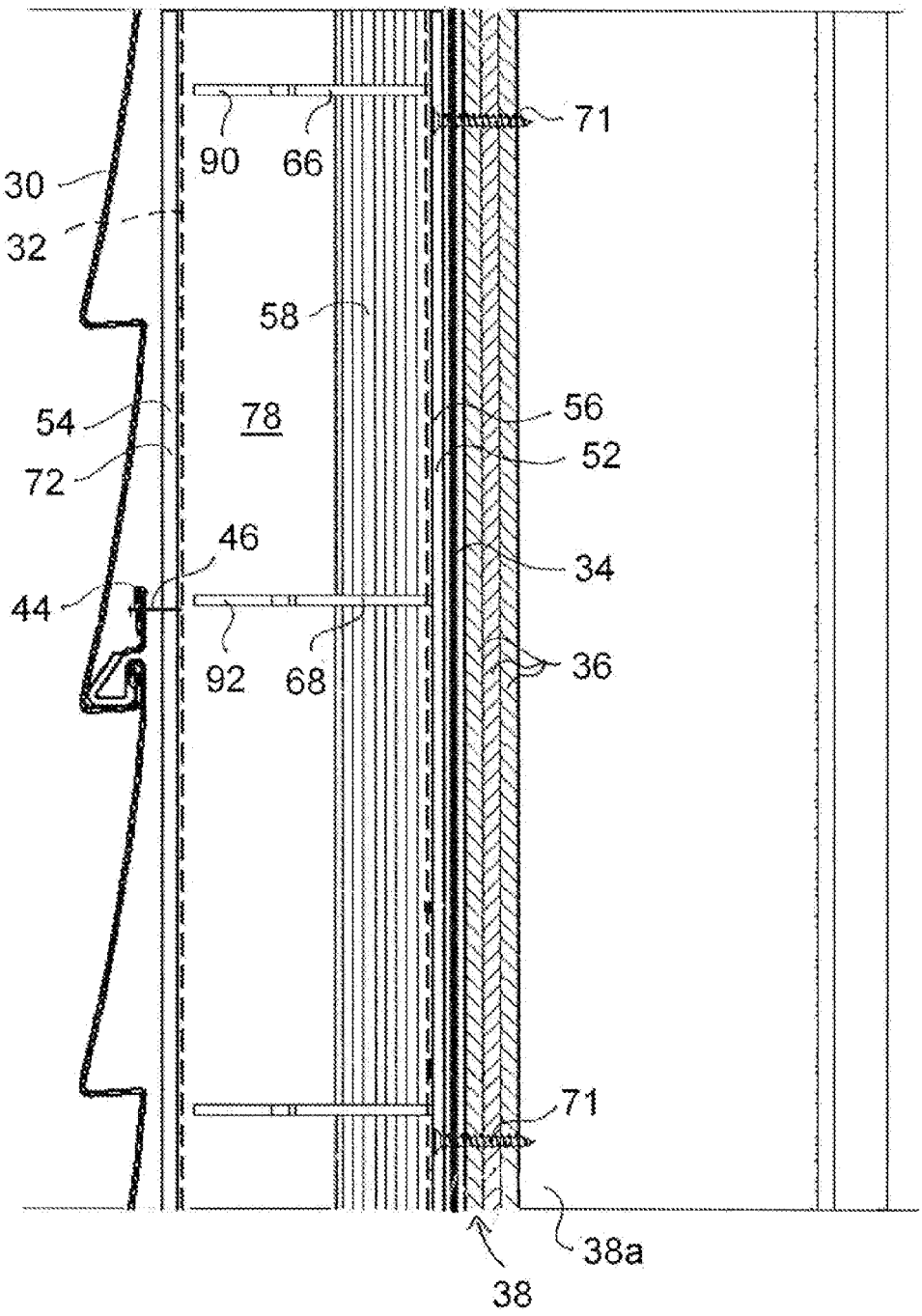
FIG. 3 is a side view of the attachment system of FIG. 1 shown in one type of application.
Figure 4:
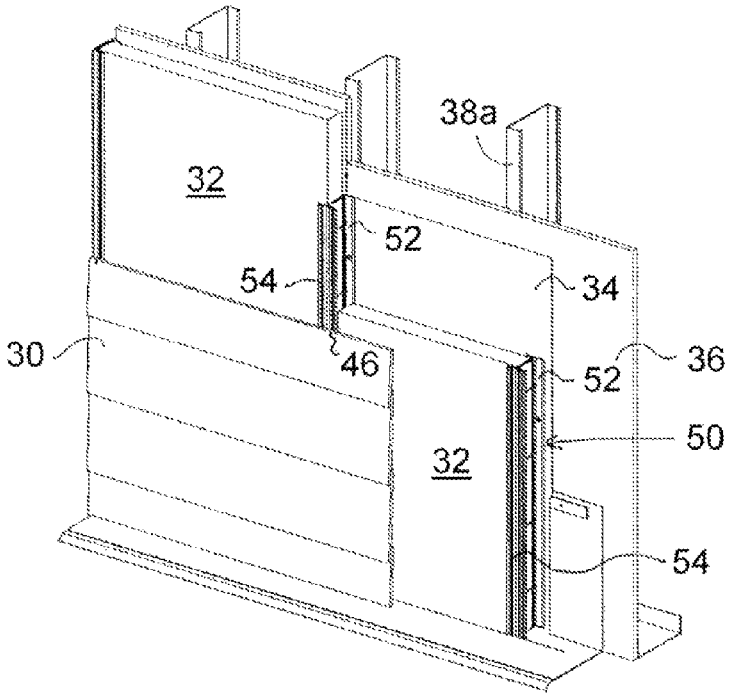
FIG. 4 is a perspective view of the attachment system of FIG. 1 shown in the application of FIG. 3.
Figure 5:
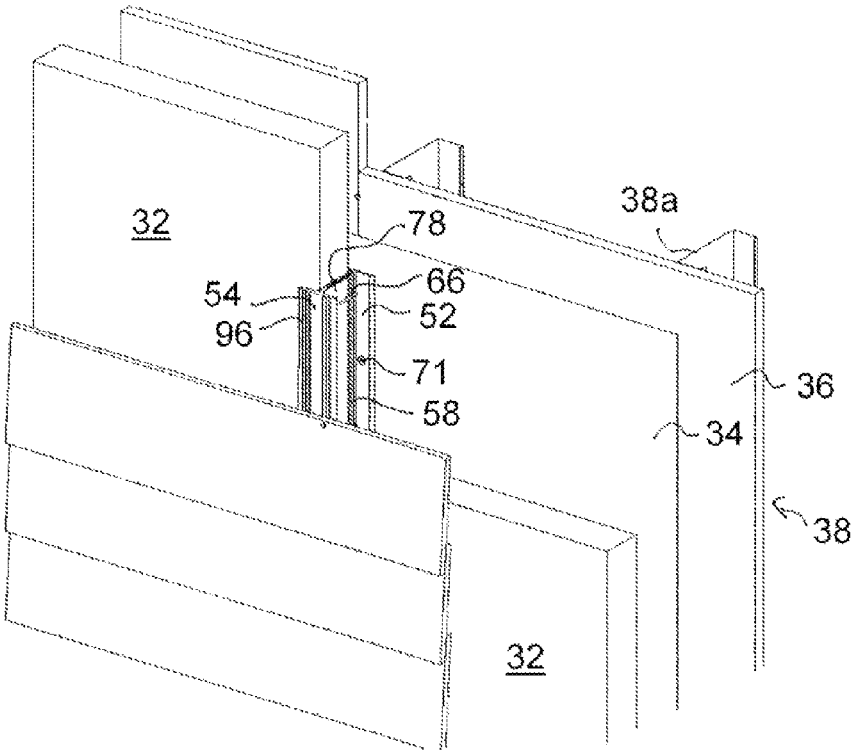
FIG. 5 is an enlarged perspective view of the attachment system from FIG. 4.

FIGS. 1-5 show a siding attachment system 50. The system 50 comprises a base 52 and an attachment member 54. In some embodiments, both components are manufactured using a semi-rigid plastic material. FIG. 3 shows the system deployed in one type of application. The base is attached to a backup wall 38. In some embodiments, the backup wall 38 may have an air barrier (AB) and/or weather-resistant barrier (WRB) 34, placed over an exterior wall board or sheathing 36, placed over wall studs 38*a*. In some applications, the base may be attached over the air barrier and/or weather-resistant barrier 34. The base may be used on other walls or backup wall arrangements known in the art.

The base 52 has a back plate 56 and an engaging wall 58 extending from the back plate. In some embodiments, the wall 58 extends perpendicular from the back plate. The wall 58 has a plurality of base teeth 60 extending along opposite sides of the engaging wall 58, a back end 62 adjacent the back plate 56, a front end 64 opposite the back end 62. The base teeth on a first side of the engaging wall are mirror image identical to the corresponding base teeth on the opposite side of the engaging wall as shown in FIG. 2.

While the engaging wall is shown having teeth along its entire length between the back end 62 and front end 64, in some embodiments, a portion thereof may be flat or blank without teeth. The engaging wall has upper and lower guide bars 66, 68 on opposite sides of the engaging wall that extend beyond the teeth. The guide bars have a flat surface.

The back plate 56 comprises through going mounting fastener apertures/holes 70. While three apertures are shown any number of apertures can be provided and placed about the back plate. Fasteners, such as screws 71, are used to secure the base plate 56 to the backup wall 38.

The attachment member 54 has a mounting plate 72 and a receiving wall 74. The receiving wall 74 has opposite outer wall portions 76, 78, and a receiving recess or gap 80 between the outer wall portions 76, 78. An end opening 88 provides access to the receiving recess 80 opposite the mounting plate 72. At an outer end of each wall portions 76, 78 opposite the base is a toothed section 82. The tooth section 82 comprises receiving teeth 84 extending from the wall portions 76, 78 into the receiving recess 80. The receiving teeth 84 on the first outer wall portion 76 are mirror image identical to the corresponding receiving teeth on the opposite second outer wall portion 78, as shown in FIG. 2. Therefore there are matched pairs of opposite receiving teeth that engage corresponding opposite sides of the engaging wall, as is shown in FIG. 2.

A blank portion 86 extends from the tooth section 82 to the mounting plate 72.

The receiving wall has upper and lower guide recesses 90, 92 in each of the outer wall portions 76, 78. The guide recesses provide side directed access to and out of the receiving recess 80. The upper and lower guide recesses 90, 92 are configured to receive the guide bars 66, 68 respectively. When the guide bars are received in the guide recesses, the attachment member 54 is secured against vertical movement in the directions H and I relative to the base. The recess 90, 92 are perpendicular to the mounting plate 72, and more specifically to the front face 95.

In one application, the base 52 is attached to the backup wall 38 with screws 71, insulation panels 32 are placed over a portion of the base 52 adjacent one or both sides of the engaging wall 58. The thickness of the back plate 56 of the base 52 spaces the insulation panels 32 from the backup wall 38. The resulting gap 57 facilitates drainage. Then the receiving wall 74 of the attachment member 54 is moved so that end opening 88 is aligned with the engaging wall 58 of the base 52, and more particularly the front end 64 of the engaging wall 58. The front end 64 is arrow shaped. The opposite sides of the end opening have angled surfaces to receive the arrow shaped front end 64. The attachment member 54 is moved in the direction A of FIG. 2. The receiving teeth 84 engage and slide over the base teeth 60 and drive the outer wall portions 76, 78 outward and away from each other in the directions C and D, respectively. The outer wall portions are driven outward because the widest portion of the wall long the tooth section is wider than the narrowest portion of the receiving recess 80 in the tooth section.

As the attachment member 54 moves in the direction A, the outer wall portions 76, 78 reciprocate or ratchet between expanding in the directions C and D, respectively, as the widest portion of the base teeth 60 encounter the widest portion of the receiving teeth 84, and then falling back in the directions E and F, respectively, as the narrowest portion of the base teeth 60 encounter the narrowest portion of the receiving teeth 84 as the recess teeth ride up and down along the base teeth. The outer wall portions are semi-flexible within a range of motion and biased in the directions E and F to a certain point at least sufficient to achieve the interlocked engagement of the receiving recess teeth with the base teeth as shown in FIG. 2.

The attachment member 54 can be moved forward in the direction A until a rear face 94 of the mounting plate 72 contacts or is in close proximity to a front face 42 of an insulation panel 32. In this way, the mounting plate secures and holds the insulation panel(s) 32 adjacent the backup wall 38 without the need for adhesive backing on the insulation panel(s). The attachment member has a range of motion from where only the first base tooth 60*a* of the engagement wall in is the recess adjacent the first recess tooth 84*a* to where the arrow shaped end front end 64 is received in the corresponding arrow shaped end portion 98 of the recess 80. Therefore, the attachment member is movable relative to the base to account for and secure insulation panels of various depths.

The attachment system 50 transfers compressive force or load that is provided to the exterior of the siding, such as by winds, through the attachment system, onto the backup wall 38. In some applications, the force or load is transferred from the attachment to the outer face of the insulation panel, through the insulation panels and onto the backup wall 38. In some applications, the mounting plate is substantially parallel to the back plate when the attachment member is joined to the base.

To remove the attachment member 54 from the base, the outer wall portions 76, 78 must be expanded in the directions C and D, respectively, until the receiving teeth 84 release from base teeth 60 sufficiently to allow clearance between the two sets of teeth and the attachment member to be withdrawn in the direction B of FIG. 2.

The front face 95 of the mounting plate 72 has a plurality of vertically extending fastener grooves 96. In some embodiments, these fastener grooves extend the entire length of the front face 95. The fastener grooves 96 receive the end point 48 of a fastener such as a nail 46. The groove prevents the nail, screw, or other fastener from moving out of place when first being driven or penetrating the front face 95. As shown in FIG. 3, a siding mount 44 of the siding system 30 is attached the mounting plate 72 by the nail 46. The mount 44 is shown spaced apart from the front face 95, but in some applications the mount will be in surface-to-surface contact with the front face 95.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A siding attachment system for connecting siding to a support wall, comprising:

a base comprising an engaging wall extending transversely from a back plate, the engaging wall comprising a plurality of base teeth, the back plate configured to attach to the support wall; and, an attachment member comprising a receiving wall extending transversely from a mounting plate, the receiving wall comprising a receiving opening configured to receive the engaging wall, the receiving opening is transverse to the mounting plate, the receiving wall comprises two interior walls adjacent the receiving opening, each interior wall comprises a one or more receiving teeth extending into the receiving opening to engage one or more of the base teeth to releasably join the attachment member to the base, the mounting plate comprises a surface for supporting siding, the mounting plate is spaced apart from the back plate, the engaging wall comprises a plurality of alignment protrusions, the receiving wall comprises a plurality of alignment recesses, the attachment member is prevented from moving in a vertical direction when the alignment protrusions are received in the alignment recesses.

2. The system of claim 1, wherein the engaging wall is perpendicular to the back plate, and the receiving wall is perpendicular to the mounting plate.

3. The system of claim 2, wherein the mounting plate is substantially parallel to the back plate when the attachment member is joined to the base to allow a portion of an insulation panel to be placed between the mounting plate and the attachment member.

4. The system of claim 1, wherein the mounting plate is substantially parallel to the back plate when the attachment member is joined to the base.

5. The system of claim 1, wherein the receiving opening extends along an entire vertical length of the receiving wall.

6. The system of claim 1, wherein the plurality of alignment protrusions are a plurality of horizontally extending alignment bars, at least one horizontally extending alignment bar of the plurality of alignment bars located on opposite exterior surfaces of the engaging wall; and the plurality of alignment recesses are a plurality of horizontally extending alignment recesses, and when the alignment bars are received in the alignment recesses the attachment member is prevented from moving in a vertical direction.

7. The system of claim 1, wherein the surface for supporting siding of the mount plate comprises vertically extending fastener grooves for receiving fasteners connecting siding to the mount plate; the mounting plate comprises a back face opposite the surface for supporting siding, the receiving wall extends transversely from the back face.

8. The system of claim 1, wherein the engaging wall has at least two opposite sides; the plurality of base teeth extend along substantially an entire surface of each of the two opposite sides.

9. The system of claim 1, wherein the engaging wall is perpendicular to the back plate, and the receiving wall is perpendicular to the mounting plate;

the mounting plate is substantially parallel to the back plate when the attachment member is joined to the base;

the receiving opening extends along an entire vertical length of the receiving wall;

the plurality of alignment protrusions are a plurality of horizontally extending alignment bars, at least one horizontally extending alignment bar of the plurality of alignment bars located on opposite exterior surfaces of the engaging wall, and the plurality of alignment recesses are a plurality of horizontally extending alignment recesses, and when the alignment bars are received in the alignment recesses the attachment member is prevented from moving in the vertical direction;

the plurality of horizontally extending alignment recesses extend through the engaging wall;

the surface for supporting siding of the mount plate comprises vertically extending fastener grooves for receiving fasteners connecting siding to the mount plate.

10. The system of claim 1, wherein the one or more teeth on one of the two interior walls matches the one or more teeth on the other of the two interior walls.

11. A siding attachment system for connecting siding to a vertical support wall, comprising:

a base comprising a vertical-engaging wall extending transversely from a back plate and vertically along the back plate, the engaging wall comprising a plurality of base teeth, the back plate configured to attach to the vertical support wall; and, an attachment member comprising a vertical receiving wall extending from a siding mount plate and vertically along the siding mount plate, the receiving wall comprising a vertically elongated receiving slot, the elongated slot is transverse to the mount plate, the receiving slot comprises a plurality of opposing receiving teeth, the elongated receiving slot configured to receive the engaging wall and the opposing receiving teeth configured to engage the base teeth to prevent the attachment member from moving in at least one horizontal direction;

the vertical engaging wall comprises a plurality of alignment protrusions, the vertical receiving wall comprises a plurality of alignment recesses, the attachment member is prevented from moving in a vertical direction when the alignment protrusions are received in the alignment recesses.

12. The system of claim 11, wherein the engaging wall is perpendicular to the back plate, and the receiving wall is perpendicular to the mount plate; and the mount plate is substantially parallel to the back plate when the attachment member is joined to the base.

13. The system of claim 11, wherein the vertically elongated receiving slot extends along an entire vertical length of the receiving wall.

14. The system of claim 11, wherein the plurality of alignment protrusions are a plurality of horizontally extending alignment bars, at least one horizontally extending alignment bar of the plurality of horizontally extending alignment bars located on opposite exterior surfaces of the engaging wall; and the plurality of alignment recesses are a plurality of horizontally extending alignment recesses, and when the alignment bars are received in the alignment recesses the attachment member is prevented from moving in the vertical direction.

15. The system of claim 14, wherein horizontally extending alignment recesses extend through an entire thickness of the receiving wall.

16. The system of claim 11, wherein the mount plate comprises a front face, the front face comprises vertically extending fastener grooves for receiving fasteners connecting siding to the mount plate, mount plate comprises a back face, the back face is opposite the front face, the vertical receiving wall extends transversely from the back face.

17. The system of claim 11, wherein the opposing receiving teeth are configured to releaseably engage the base teeth.

18. The system of claim 11, wherein the vertically elongated receiving slot comprises a vertical height, a depth, and a horizontal gap between opposite sides of the vertically elongated receiving slot, the vertical height is greater than the horizontal gap.

19. The system of claim 11, wherein the receiving wall comprises a receiving wall intersecting portion that intersects with the siding mount plate, the receiving wall intersecting portion comprises a receiving wall intersecting vertical height and a receiving wall intersecting horizontal thickness, the receiving wall intersecting vertical height is greater than the receiving wall intersecting horizontal thickness.

20. A method of attaching siding to a support wall, comprising the steps of:

attaching a back plate of a base to the support wall, the base having a vertical engaging wall extending perpendicularly from the back plate, the engaging wall comprising a plurality of base teeth on opposite sides of the engaging wall;

aligning horizontally a vertically elongated receiving recess of a receiving wall of an attachment member with the engaging wall;

moving the elongated receiving recess over the receiving wall;

engaging a plurality of receiving teeth on opposite sides of the elongated receiving recess with the plurality of base teeth of the receiving wall to prevent the attachment member from moving in at least one first horizontal direction;

holding an insulation panel adjacent the support wall with a mount plate of the attachment member, the mount plate is perpendicular to the receiving recess;

attaching siding to the mount plate of the attachment member.

21. The method of claim 20, comprising the step of, after aligning horizontally, aligning vertically the elongated receiving recess of a receiving wall with the engaging wall by aligning a plurality of guide recesses of the receiving wall with a plurality of guide bars of the engaging wall.

22. The method of claim 20, wherein the step of moving comprises moving the elongated recess in a second horizontal direction opposite of the first horizontal direction; and wherein the step of engaging comprises sliding the receiving teeth over the base teeth until the mount plate is in the desired position.

23. The method of claim 20, wherein the step of holding comprises holding the insulation panel against the back plate with the mount plate where the back plate spaces the insulation panel from the support wall.

* * * * *